US005586765A

United States Patent [19]

Lackey

[11] Patent Number: 5,586,765

[45] Date of Patent: Dec. 24, 1996

[54] METHOD OF PLAYING A WORD SCRAMBLE GAME

[76] Inventor: Glenn D. Lackey, 9014 Carlotta Ct., Houston, Tex. 77074

[21] Appl. No.: 342,148

[22] Filed: Nov. 18, 1994

[51] Int. Cl.[6] ..... A63F 1/00

[52] U.S. Cl. ..... 273/299; 273/429; 273/153 R; 273/432

[58] Field of Search ..... 273/299, 272, 273/153 R, 429–432

[56] References Cited

U.S. PATENT DOCUMENTS 4,666,161 5/1987 Elesie et al. ..... 273/246

5,195,753 3/1993 Brukl et al. ..... 273/429

5,207,435 5/1993 Tanner ..... 273/429

*Primary Examiner*—Benjamin H. Layno

*Attorney, Agent, or Firm*—Michael B. Jolly

[57] ABSTRACT

A word scramble game for two or more players utilizing a plurality of cards wherein each card has imprinted a plurality of words with a scrambled version of the word's letters next to each word. One of the players selects and presents the selected scrambled version of the word to the other player or players who then attempt to unscramble the letters to form the correct word within the given time limit. Points are awarded to the player who is the first to form a word. A player wins when his or her score reaches a pre-determined value.

4 Claims, 5 Drawing Sheets

| | | | |
|---|---|---|---|
| 1. | TAFFETA | - | AAFEFTT |
| 2. | HARMFUL | - | HULMRAF |
| 3. | NECKTIE | - | EECNITK |
| 4. | LANTERN | - | NENTRAL |
| 5. | WORLDLY | - | RWYLDLO |
| 6. | FASCIST | - | ACSSIFT |

| | | | |
|---|---|---|---|
| 1. | TAFFETA | - | AAFEFTT |
| 2. | HARMFUL | - | HULMRAF |
| 3. | NECKTIE | - | EECNITK |
| 4. | LANTERN | - | NENTRAL |
| 5. | WORLDLY | - | RWYLDLO |
| 6. | FASCIST | - | ACSSIFT |

Figure 1

METHOD OF PLAYING A WORD SCRAMBLE GAME

INTRODUCTION

This invention relates to word games and in particular to a word scramble game utilizing a plurality of cards where each card has imprinted a plurality of words with a scrambled version of the word's letters next to each word.

The prior art is replete with various types of word forming and word scramble games. Unlike the prior art, the present invention allows as few as two or as many as an entire classroom of children to compete against one another.

BRIEF DESCRIPTION OF THE DRAWINGS

FIG. 1 is an illustrated drawing of the front side of one of the word cards depicting the imprinted words and corresponding scrambled version of such word.

DETAIL DESCRIPTION OF THE DRAWINGS

Figure 2:
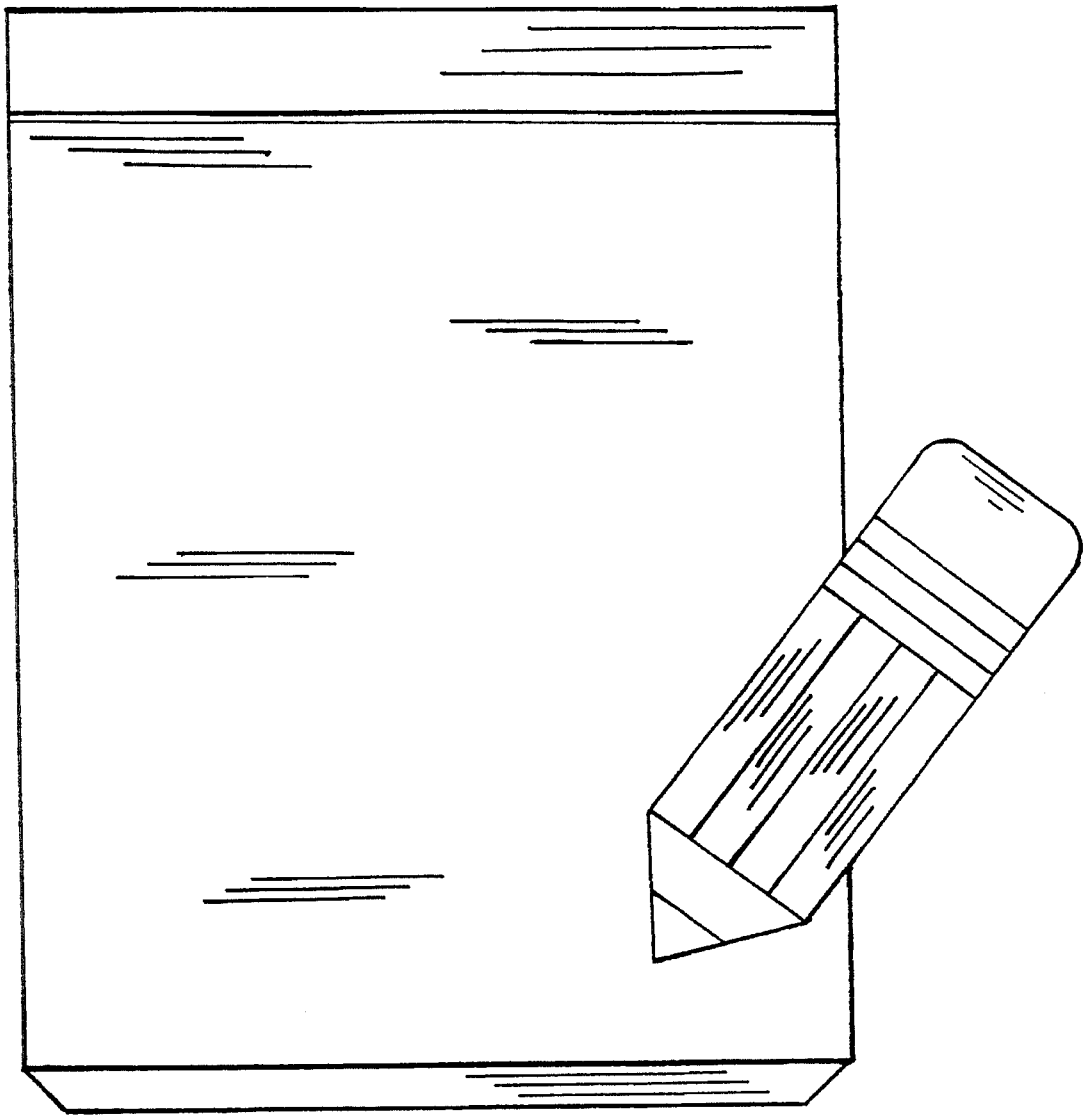
FIG. 2 is an illustration of writing paper.
Figure 3:
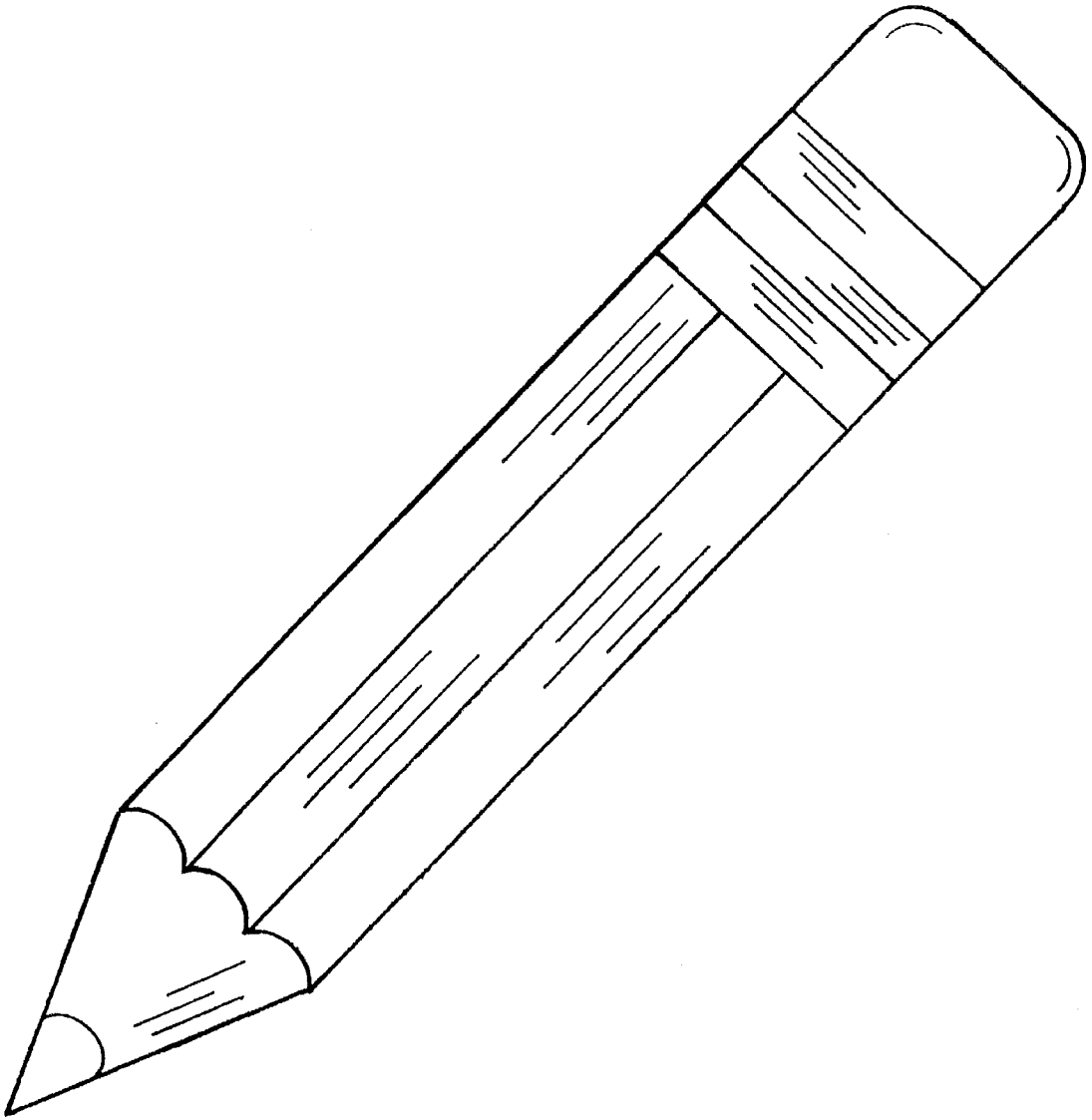
FIG. 3 is an illustration of a writing instrument.
Figure 4:
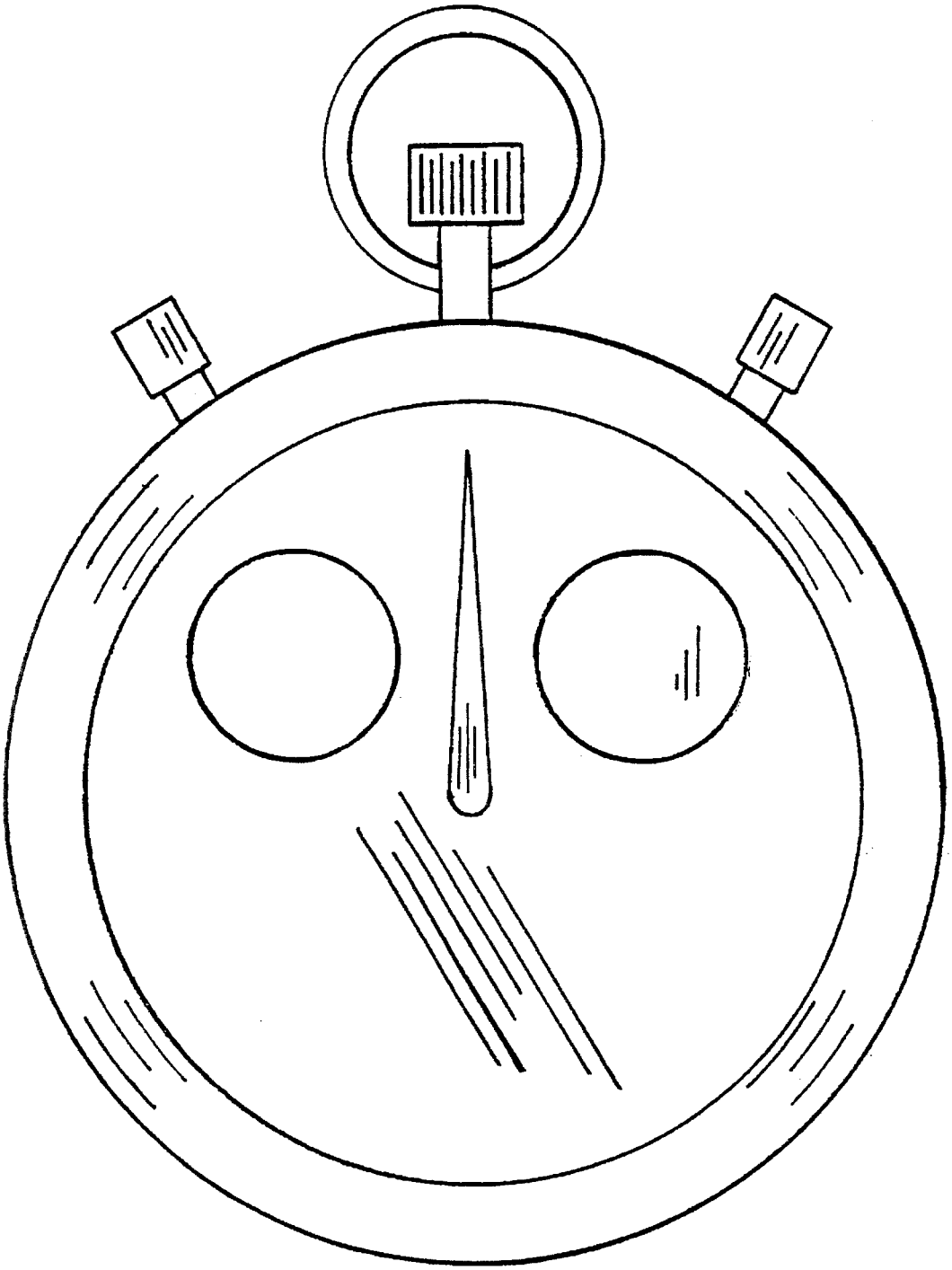
FIG. 4 is an illustration of a watch used as a timing means.
Figure 5:
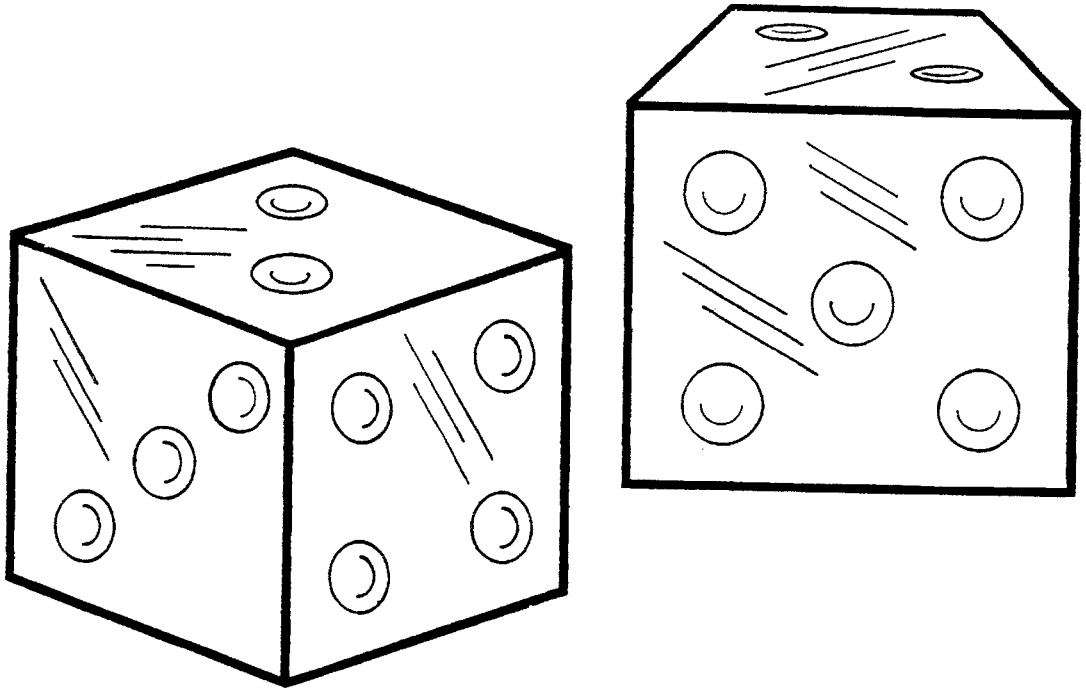
FIG. 5 is an illustration of a die.

While the present invention will be described fully hereinafter with reference to the accompanying drawing, in which a particular embodiment is shown, it is to be understood at the outset that persons skilled in the art may modify the invention herein described while still achieving the desired result of this invention. Accordingly, the description which follows is to be understood as a broad informative disclosure directed to persons of skill in the appropriate arts and not as limitations upon the present invention.

Referring to FIG. 1, the word scramble game is played utilizing word scrambled cards. The back of the cards have common patterns or designs, while the front side of the cards contain a plurality of printed words. The number of printed words on each card can be as few as one and a maximum number limited by word print size and card size. The preferred embodiment utilizes six words per card. The cards are most preferable constructed of plastic laminated rigid paper material, however other suitable materials may be employed. The card dimensions may vary, however a standard three inch by five inch card is the preferred size. The words are correctly spelled in a row along the left side of the card and directly opposite each word on the right side of the card is a scramble version of the word. Each of the words on a given card contain the same number of letters. Additionally, the cards contained within a given set of cards contain words with the same number of letters. The number of cards per card set may vary, however the preferred embodiment utilizes one hundred cards per set. Alternate sets of cards may be provided containing words ranging from three to ten letters. Fewer or more letters may be provided depending upon the ease or difficulty desired for play. In order to differentiate sets of cards the cards from a given set may be marked by placing an arabic numeral or the like on the card's back corresponding to the number of letters in the words for that set of cards. Card set differentiation may also be accomplished by providing different color backing for cards of each set of cards. The words used on the cards are those found in a standard dictionary, non-technical, non-hyphenated, and non-capitalized. Card sets containing words from common subject matter, such as entertainment, sports, science, and the like could also be utilized.

Other equipment necessary for playing this game includes a timing device, a die, a writing instrument and writing paper for each participant.

The foregoing embodiment and examples are to be considered illustrative, other than restrictive of the invention and those modifications which come within the meaning and range of equivalents of the claims are to be included therein.

RULES

OBJECTIVE

The objective of this word scramble game is to be the first player to unscramble the given scramble letters and form the given word.

PLAY

Each player draws a card from the card set concealing the printed words from other players. Each player rolls the die and the player with the high die number will be the first "teacher". If the die roll results in a tie between players those players roll the die again until the "teacher" is determined. Once play has started the "teacher" role is past clockwise around the table to the other players. The teacher selects a word from his or her word card hoping that the other players will not be able to unscramble the letters and form the word. The teacher reads carefully the letters of the scrambled word in the order as printed on the card. The other players write down the scramble letters on their paper. When the teacher has completed reading the scramble letters the timing device is immediately activated.

The amount of time given to play each round should vary and correspond to the degree of difficulty. The degree of difficulty is increased by the use of cards with more letters per word. After the timing device is activated each player races his or her opponent attempting to be the first to unscramble the word correctly. When a player has unscrambled the word he or she gives a signal for recognition from the teacher. The signal for recognition may be the player raising his or her hand or verbally indicating that he or she has formed the word. The teacher acknowledges whether or not the given word is correct. If the player's given word is correct the player is awarded one point. If the player gives an incorrect word, that player loses a point and play continues until the correct answer is given or until the time period expires. If no players give a correct answer during the play period then the teacher is awarded a point. After each play period the teacher role is past clockwise to the next player. The new teacher again selects and presents the scrambled letters to the other players and activates the timing device. New cards are drawn from the card set after the player has used all word choices on the given card. Play is continued until a player reaches a predetermined score thereby winning the game.

As an option, after a player forms a word which is not the correct word however the word is found in a dictionary containing the same letters and if such unscramble version is the first answer given by any player that player is awarded a point. Play is then continued for the remainder of the time period and if that same player or another player forms the correct word, that player also is awarded a point. Again, play is continued until a player reaches a predetermined score thereby winning the game.

I claim:

1. A method of playing a word scramble game for two or more players comprising the steps of:

a) providing a plurality of cards forming a card set wherein each card has printed thereon a plurality of correctly spelled words opposite a scramble version of each such word;

b) providing each player with paper and a writing instrument;

c) providing a timing means;

d) a die;

e) starting a round by each player drawing a card from the card set and positioning the card such that the words on the card are not in clear view of the other players;

f) providing a means for determining which player should be selected to choose and verbally present the scrambled letters to the other player or players;

g) providing a means for presenting the scrambled letters to the other player or players;

h) activating the timing means;

i) each player as quickly as possible, writing on their own paper attempts to unscramble the given letters and form the correct word within the time period;

j) a means for player recognition when the player has formed a word from the given scrambled letters;

k) providing point values to the player who provides the correct word from the scramble letters within the time period;

l) providing point values to the player who first provides a word formed from the given scrambled letters and such word is not the same word provided from the given card selection;

m) providing point values to the player who presented the scramble letters to the other player or players and which no player provided a correct unscramble version of the word;

n) repeating steps g through l until a player wins by reaching a predetermined number of total points.

2. The method according to claim 1 further providing said means for determining player selection comprising the players rolling a die and the player with the high die value becomes the player to present the scrambled letters to the other player or players.

3. The method according to claim 1 further providing said player recognition means comprising the player's verbal response when said player has formed a word from said scramble letters.

4. The method according to claim 1 further providing a deduction of point values from a player's score when the player provides a word formed from said scrambled letters which is not the correct word provide from the given card selection.

* * * * *